United States Patent [19]

Speer

[11] Patent Number: 4,469,647

[45] Date of Patent: Sep. 4, 1984

[54] METHOD AND APPARATUS FOR MIXING, CASTING AND DISPENSING FRICTION-SENSITIVE PYROTECHNIC MATERIALS

[75] Inventor: Spencer J. Speer, Ontario, Calif.

[73] Assignee: General Dynamics, Pomona, Calif.

[21] Appl. No.: 478,439

[22] Filed: Mar. 24, 1983

[51] Int. Cl.[3] ..... C06B 21/00

[52] U.S. Cl. ..... 264/3 C; 86/20 R; 149/42; 149/43; 149/44; 149/61; 149/76; 149/83; 149/87; 149/109.6; 264/3 R

[58] Field of Search ..... 264/3 R, 3 C; 86/20 B

[56] References Cited

U.S. PATENT DOCUMENTS

| | | | |
|---|---|---|---|
| 503,587 | 8/1893 | Du Pont | 149/99 |
| 976,211 | 11/1910 | Du Pont | 149/65 |
| 2,071,114 | 1/1936 | Olsen et al. | 198/789 |
| 2,213,255 | 9/1940 | Olsen et al. | 149/11 |
| 2,646,596 | 7/1953 | Thomas et al. | 264/3 R |
| 2,973,257 | 2/1961 | Ryker et al. | 149/19.1 |
| 2,992,088 | 7/1961 | Burkardt et al. | 149/109.6 |
| 3,173,817 | 3/1965 | Wright | 102/292 |
| 3,180,771 | 4/1965 | Hatteri et al. | 149/45 |
| 3,193,991 | 7/1965 | Browning et al. | 55/185 |
| 3,296,043 | 1/1967 | Fluke et al. | 149/19.92 |
| 3,393,255 | 7/1968 | Pell et al. | 264/3 R |
| 3,702,271 | 11/1972 | Henderson et al. | 149/38 |
| 3,774,496 | 11/1973 | Roach | 86/20 C |
| 3,897,237 | 7/1975 | Musselman et al. | 71/1 |
| 4,138,282 | 2/1979 | Goddard et al. | 149/19.3 |

*Primary Examiner*—Stephen J. Lechert, Jr.
*Assistant Examiner*—Howard J. Locker
*Attorney, Agent, or Firm*—Henry M. Bissell; Edward B. Johnson

[57] ABSTRACT

Constituent pyrotechnic materials are dispensed by prescribed weight or volume into a single container containing an excess volume of an inert liquid, such as Freon T.E., having the property of preventing ionization of the materials. The pyrotechnic materials in inert fluid medium are then stirred so as to obtain an homogeneous slurry mixture. The slurry is allowed to settle and the inert fluid is decanted off for future reuse. The remaining slurry is dispensed into individual containers under pressure. The slurry is vacuum dried at a safe temperature to minimize the accidental ignition hazard while removing the remaining inert liquid, thus forming individual casts of pyrotechnic material. The casts are permitted to reach ambient temperature and pressure at predetermined rates so as to prevent cracking of the pyrotechnic charges.

10 Claims, 1 Drawing Figure

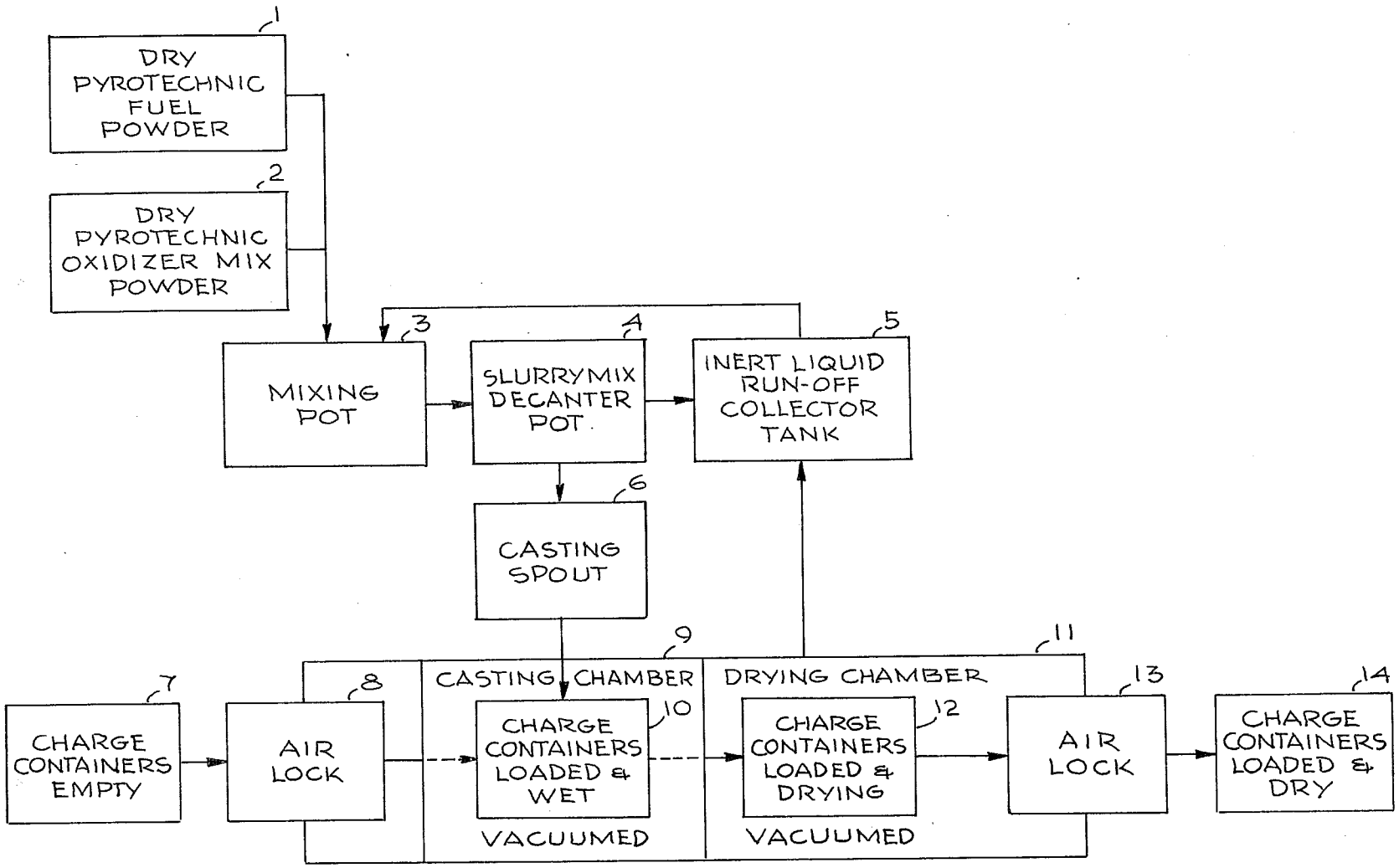
1
DRY PYROTECHNIC FUEL POWDER
2
DRY PYROTECHNIC OXIDIZER MIX POWDER
3
MIXING POT
4
SLURRYMIX DECANTER POT
5
INERT LIQUID RUN-OFF COLLECTOR TANK
6
CASTING SPOUT
7
CHARGE CONTAINERS EMPTY
8
AIR LOCK
9
CASTING CHAMBER
10
CHARGE CONTAINERS LOADED & WET
VACUUMED
11
DRYING CHAMBER
12
CHARGE CONTAINERS LOADED & DRYING
VACUUMED
13
AIR LOCK
14
CHARGE CONTAINERS LOADED & DRY

METHOD AND APPARATUS FOR MIXING, CASTING AND DISPENSING FRICTION-SENSITIVE PYROTECHNIC MATERIALS

BACKGROUND OF THE INVENTION

1. Field of the Invention

This invention relates to pyrotechnic materials and, more particularly, to a method for safe handling or pyrotechnic materials during mixing, casting and dispensing operations.

2. Description of the Prior Art

Methods have been available in the prior art in which small batches of pyrotechnic materials are mixed together. The batches are kept small to minimize the safety hazard in the event of accidental ignition due to friction heat as the fine particles of the pyrotechnic materials are being tumbled to obtain a homogeneous blend. The blending is usually done dry because of requirements for maintaining moisture within the batch to very low levels. After mixing, the dry batch is usually manually dispensed into the charge containers or shipping containers by weight or by volume.

The dry mixing and tumble blending and manual dispensing are each extremely hazardous operations. Pyrotechnic materials are inherently very sensitive to ignition induced by relatively low temperatures that can be generated by nothing more than a friction of the particles of material rubbing against each other during the dry processing. Indeed, some of these dry pyrotechnic materials are recognized as being so sensitive that the preferred mixing technique involves performing the actual blending by vibration means after the constituent materials for the blend have been loaded in strictly regulated, limited quantities into the final containers. In this way, process handling and resultant process hazards from accidental ignition of the mix are minimized.

Many different methods have been employed in the attempts to solve the problems presented. Most have either presented new problems or only partially solved the problems presented or both. Most of these prior art methods have thus met special needs as presented by specific problems and have therefore served only specific purposes. These prior art methods, among other disadvantages, have caused unacceptable degradation of ignition properties, have formed active compounds with the original pyrotechnic materials, have been unreliable and unpredictable in operation and have been expensive, complicated and still hazardous to effectuate.

As an example of these prior art methods, U.S. Pat. No. 3,702,271 discloses a method wherein an explosive slurry comprised of an organic liquid hydrocarbon is mixed, allowed to settle for decanting of excess hydrocarbon, further agitated under vacuum to remove an azeotropic mixture of the hydrocarbon and water, and then cast under vacuum to still further ensure the removal of any remaining hydrocarbon or azeotrope. This patent is specifically related to a process for the removal of water from explosive or propellant ingredients after manufacture and therefore does not address specifically the problem of providing a slurry mixture for processing explosive mixtures to form a final dispensed product.

U.S. Pat. No. 976,211 discloses the use of a slurry to minimize explosion during incorporation of explosive ingredients. The slurry utilized is defined as a volatile hydrocarbon such as gasoline, kerosene or benzene. Although this slurry media was particularly useful in the mixing of the explosive materials available at the date of this patent, these materials are not particularly useful in mixing the much more sensitive explosive materials now available.

U.S Pat. No. 3,180,771 discloses a method of preparing a rocket monopropellant compound wherein Freon 13 is disclosed as useful as a solvent for processing of low temperature ammonia with concentrated ozone for a chemical reaction which forms ammonia ozonate and other related compounds as a precipitate. These compounds are specifically for usage in high specific impulse rocket monopropellants.

Other patents which describe various techniques for forming pyrotechnic mixtures are U.S. Pat. Nos. 503,587, 2,027,114, 2,213,255, 2,646,596, 2,973,257, 2,992,088, 3,173,817, 3,193,991, 3,296,043, 3,393,255, 3,774,496, and 3,897,237.

A process technique is needed, therefore, to provide for safe handling of pyrotechnics during the mixing, blending and dispensing of these materials. A significant step forward in the art would be realized by a process which provides for safe handling during any one of the process phases, i.e. either mixing, blending or dispensing, and in addition assure the integrity of the ignition qualities of the blend.

SUMMARY OF THE INVENTION

In brief, arrangements in accordance with the present invention comprise methods and apparatus for mixing, blending and dispensing pyrotechnic materials in a safe and efficient manner. Each constituent pyrotechnic material to be blended is dispensed by the prescribed weight or volume according to the formulation into a single container, and an inert liquid such as Freon T.E. is added, the inert liquid having the property of preventing ionization of the materials. Freon is a registered trademark covering the goods: fluorinated hydrocarbons. Freon T.E. is a blend of Freon T.F. (trichlorotrifluoroethane) and specially denatured anhydrous ethanol (ethyl alcohol). The resultant mixture is then stirred so as to obtain an homogeneous blend. After stirring, the inert mixture is allowed to settle and the inert liquid is decanted off for future reuse. After decanting, the slurry mixture of pyrotechnic mix materials and residual inert liquid medium is cast into an individual charge container and dried under controlled vacuum and temperature conditions depending upon the casting geometries, slurry volumes required and slurry viscosities encountered. These vacuum and temperature conditions are determined empirically by pilot lot process testings and are employed in the subsequent volume production runs. After dryout, the casts are also controlled to reach ambient temperature and pressure at predetermined rates so as to further prevent cracking of the pyrotechnic casts.

BRIEF DESCRIPTION OF THE DRAWING

A better understanding of the present invention may be had from a consideration of the following detailed description, taken in conjunction with the accompanying drawing in which:

The single FIGURE is a block diagram of the system and method of the present invention.

DESCRIPTION OF THE PREFERRED EMBODIMENT

Referring now to the FIGURE, a block diagram of the system and method of the present invention is illustrated. Each constituent pyrotechnic material to be mixed is separately dispensed by a prescribed weight or volume of formulation into a single container of an inert liquid medium. The inert liquid medium is selected to have such properties as will prevent ionization of the pyrotechnic materials.

In the embodiment shown, the pyrotechnic mix constituents are indicated by blocks 1 and 2 and are used to make the pyrotechnic cast charge in the present process invention. In particular, block 1 represents dry pyrotechnic fuel powders such as aluminum and/or magnesium metal powders, and block 2 represents the dry pyrotechnic oxidizer powders such as barium nitrate, potassium perchlorate, ammonium perchlorate and the like as may be required by the final pyrotechnic mix formulation. These constituents are separately added to a mixing pot 3, where they are added to an excess volume of the selected inert liquid medium, such as Freon T.E., in a ratio of about one part of the pyrotechnic mix materials to three parts of the inert liquid medium. During the mixing phase of the process, the pyrotechnic materials are thoroughly wetted by stirring to obtain an homogenous blend of the fuel and oxidizer constituents in the pyrotechnic mix formulation. After stirring, the mixture is transferred to a slurry mix decanter pot 4, where the pyrotechnic mix is allowed to settle in the inert liquid medium. After settling, the inert liquid medium is transferred to an inert liquid run-off collector tank 5 for future reuse. After decanting much of the excess inert liquid medium, a slurry will have been formed in the pot 4 by the mixed pyrotechnic materials and residual inert liquid which cannot be practically separated from the pyrotechnic mix at this phase of the processing.

The wet slurry is dispensed, either by pressurization of the pot with an inert pressurizing gas, such as dry nitrogen, or by simple gravity, through a casting spout 6 into a vacuumed casting chamber 9 for wet loading of the mixed pyrotechnic materials into individual charge containers. The individual charge containers 7 are introduced into the vacuumed casting chamber 9 via an inlet air lock 8, where they are cast loaded, block 10, with the wet pyrotechnic mix to a prescribed loading weight or volume. After this loading, the individual charge containers are transferred, under vacuum atmosphere, into a vacuumed drying chamber 11 for controlled drying, block 12, to prescribed charge weight. The inert liquid vapors thus driven from the wet charges during the drying process are collected from the drying chamber 11 through a closed conduit system and returned to the inert liquid run-off collector tank 5 for future reuse.

According to the teaching of the present invention, the loaded and wet charge containers are vacuum dried at a temperature preferably above 100° F. but below 130° F. to minimize the ignition hazard of the pyrotechnic materials during drying. The drying temperature and the vacuum atmosphere required in the drying chamber are determined empirically for the cast charge geometries involved during pilot run testing and are maintained during the drying process for production runs to prevent cracks, voids or other similar defects from forming during the drying of the cast charges. An exemplary vacuum level which has been found suitable for one particular cast charge is in the range of 600 to 700 millimeters of mercury. This particular charge was about 2½ to 3 gms. (dry weight) and was cast in a tapered nose cone shape about 1" in diameter and about ¾" long.

After drying to prescribed charge weight, the charge containers are removed from the vacuum drying chamber through an exit air lock 13 for subsequent usage as loaded and dry charge containers ready for ignition or higher assembly into pyrotechnic devices, block 14.

Although there have been described above specific arrangements of method and apparatus for mixing, blending and dispensing pyrotechnic materials in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A method of mixing, blending and dispensing pyrotechnic materials comprising the steps of:

separately applying a selected dry pyrotechnic fuel powder and a selected dry pyrotechnic oxidizer powder into a container of an inert liquid medium comprising a blend of trichlorotrifluoroethane and ethyl alcohol in volumes sufficient to thoroughly wet the materials until a ratio of about 1 part of pyrotechnic materials to 3 parts of the liquid medium is reached;

blending the resulting contents of the container to maintain a substantially homogenous mixture of the ingredients therein;

decanting off an amount of the inert liquid medium from said mixture so as to leave a slurry of the pyrotechnic materials with the remaining inert liquid medium;

dispensing the slurry into final containers; and drying said slurry in said final containers in a vacuum within the range of about 600–700 mm. Hg. at a temperature within the range of about 100°–130° F. so as to substantially remove the remainder of said inert liquid medium, thus forming a cast of pyrotechnic material.

2. The method of claim 1 wherein the inert liquid medium consists of said blend.

3. The method of claim 1 further including the step of determining the vacuum level and drying temperature within said ranges empirically by pilot lot testing prior to volume production runs.

4. The method of claim 3 wherein the vacuum level and drying temperature are determined in accordance with the geometry, volume and viscosity of the slurry in its container.

5. The method of claim 1 further including the step of returning the pyrotechnic material casts to ambient temperature and pressure at predetermined limited rates so as to prevent cracking of the pyrotechnic material cast.

6. The method of claim 1 wherein the pyrotechnic fuel powder is aluminum or magnesium metal powder or a mixture thereof.

7. The method of claim 6 wherein the dry pyrotechnic oxidizer powder is barium nitrate, potassium perchlorate or ammonium perchlorate.

8. The method of claim 1 wherein the step of dispensing the slurry into final containers includes pressurizing the container in which the ingredients are blended to force the slurry through a casting spout into individual final containers.

9. The method of claim 8 wherein said pressurizing is effected by the use of an inert pressurizing gas.

10. The method of claim 9 wherein said pressurizing is effected by the application of pressurized dry nitrogen.

* * * * *